US008718912B2

(12) United States Patent
Wachenheim et al.

(10) Patent No.: US 8,718,912 B2
(45) Date of Patent: May 6, 2014

(54) METHOD AND DEVICE FOR CHECKING THAT AN AIRCRAFT FULFILS SUCCESSIVE TIME CONSTRAINTS

(75) Inventors: Maxime Wachenheim, Toulouse (FR); Stéphane Bostetter, Toulouse (FR); Alexandre Lanoix, Fontenilles (FR)

(73) Assignee: Airbus Operations (SAS), Toulouse Cedex (FR)

( * ) Notice: Subject to any disclaimer, the term of this patent is extended or adjusted under 35 U.S.C. 154(b) by 159 days.

(21) Appl. No.: 13/421,239

(22) Filed: Mar. 15, 2012

(65) Prior Publication Data

US 2012/0253650 A1 Oct. 4, 2012

(30) Foreign Application Priority Data

Mar. 29, 2011 (FR) ..... 11 52604

(51) Int. Cl.
*G08G 5/00* (2006.01)

(52) U.S. Cl.
USPC ..... 701/120; 701/3

(58) Field of Classification Search
USPC ..... 701/120, 14, 2, 70, 467, 3; 370/335
See application file for complete search history.

(56) References Cited

U.S. PATENT DOCUMENTS

| | | | | |
|---|---|---|---|---|
| 5,121,325 | A | 6/1992 | DeJonge | |
| 7,272,491 | B1 * | 9/2007 | Berard | 701/467 |
| 2007/0100538 | A1 | 5/2007 | Wise et al. | |
| 2008/0228333 | A1 * | 9/2008 | De Menorval et al. | 701/14 |
| 2009/0112454 | A1 | 4/2009 | Wachenheim et al. | |
| 2010/0131124 | A1 | 5/2010 | Klooster | |
| 2011/0137493 | A1 | 6/2011 | Dacre-Wright et al. | |

FOREIGN PATENT DOCUMENTS

| | | |
|---|---|---|
| FR | 2923032 | 5/2009 |
| FR | 2946161 | 12/2010 |

OTHER PUBLICATIONS

French Patent Office, Preliminary Search Report for FR 1152604, Nov. 3, 2011 (2 pgs.).

* cited by examiner

*Primary Examiner* — Marthe Marc-Coleman
(74) *Attorney, Agent, or Firm* — Wood, Herron & Evans, LLP

(57) ABSTRACT

A time constraint checking device performs a method for checking whether an aircraft is able to fulfill a plurality of successive time constraints corresponding to required times of arrival at a plurality of corresponding waypoints. The method includes comparing, for each of the waypoints, a comparison value depending on the time constraint with either an estimated time of arrival or minimum and maximum possible times of arrival based on speeds of the aircraft. The method performs different comparisons depending on whether the time constraints for a particular waypoint are a single time value or a time window, and an optimized time of arrival for meeting all future time constraints is also possible.

9 Claims, 2 Drawing Sheets

METHOD AND DEVICE FOR CHECKING THAT AN AIRCRAFT FULFILS SUCCESSIVE TIME CONSTRAINTS

TECHNICAL FIELD

The present invention relates to a method and a device for checking that an aircraft fulfills successive time constraints for the aircraft, in particular a transport airplane, upon a flight.

Within the context of the present invention, it is considered that a time constraint is a constraint requiring a given time of arrival, of the RTA ("Required Time of Arrival") type, at a particular waypoint of the flight trajectory followed by the aircraft. It could also be, instead of a given time of arrival, a given time window, as specified below.

BACKGROUND

It is known that aircrafts are able to manage a time constraint while modulating their speed. The flight management system of the Flight Management System ("FMS") type, should be able to ensure the function of fulfilling a time constraint at a given waypoint. To this end, it calculates optimum parameters, including in speed, so as to reach the specified waypoints at the expected time. A speed strategy should be defined throughout the flight plan in order to optimize the arrival at the constraint.

The flight management system calculates its predictions through comparing the time constraint Required Time of Arrival ("RTA") with an estimated time of arrival Estimated Time of Arrival ("ETA"), being directly linked to the speed. If the estimated time of arrival is lower than the time constraint, the flight management system recalculates a speed profile so as to slow down (and vice versa), the aim being converging the estimated time ETA to the constraint RTA.

The issue linked to the constraint RTA results from the fact that calculating the speed profile uses a large part of the calculation abilities of the flight management system. The process for calculating predictions comprises an iterative loop allowing for the convergence, but requiring a large calculation capacity from the embedded computer. As it is already demanding for the system to carry out the calculations for one single constraint, it is technically difficult to impose multiple RTA constraints (several successive time constraints) and to calculate the adapted speed profiles, currently, as a result of the technical limitations at the level of the embedded computer.

The present invention aims at indicating to the pilot(s) beforehand (before the first time constraint) whether the aircraft is able to fulfill the next constraints in the case of several successive time constraints.

It is also necessary to be able to manage multiple constraints in the case where constraints defined as time windows should be fulfilled, making the problem even more complex. In this case, this is no longer a conventional constraint RTA for which the aircraft is requested to arrive at a waypoint on a precise time. In such a case, it is requested that it should arrive at this waypoint in a given time interval. Thus, if the aircraft arrives at any moment of this interval, the constraint is fulfilled, otherwise not. In the case of time windows, there are numerous possible speed profiles allowing the constraint to be fulfilled.

Moreover, in this situation, it can also happen that a speed profile allowing the first constraint to be respected could lead to the impossibility of fulfilling the second constraint or a next constraint.

Indeed, the embedded computer calculates an adapted speed profile so as to reach the first constraint in the imparted time window. However, as this constraint is a window, it optimizes the speed with the only aim to fulfill the first constraint, and before arriving within the time interval. It does not take into consideration the following constraints. Indeed, it could only calculate an optimized speed profile for the first constraint. Thus, in an extreme case, it could happen that it selects a speed profile subsequently preventing it from respecting the next constraints while respecting the first constraint. For example, if the second time constraint is tight, it requires arriving at the point of the first constraint in a tighter time window than this first constraint. But the system, not taking into consideration the speed profile for the second constraint, could very well decide to apply a slow speed profile (in order to save fuel, for instance) that will allow it to arrive very late up to the constraint so that it is impossible to catch up the delay for fulfilling the second constraint.

Thus, without the complete calculation of the speed profile throughout the whole flight plan, up to the last time constraint, it becomes impossible to know whether a plurality of successive time constraints are fulfilled or not.

The present invention aims at overcoming the above mentioned drawbacks and providing an operator, including a pilot of the aircraft, with a piece of information relating to fulfilling successive time constraints, before even the first constraint has been reached, and this without having to calculate the speed profile until the last constraint. More precisely, the present invention relates to a method for checking whether, upon a flight of an aircraft, the latter is able to fulfill a plurality of successive time constraints, each of which is relative to a required time of arrival in a particular waypoint.

SUMMARY OF THE INVENTION

To this end, said method is remarkable according to this invention in that at least means are provided for providing said required times of arrival and means for determining the current speed of the aircraft, and in that:

A/ for the next waypoint (that is the one the aircraft will reach first):

a) as a function of the current speed of the aircraft, a time of arrival at said next waypoint is estimated; and b) this estimated time of arrival is compared to at least one comparison value depending on said required time of arrival at said next waypoint, for checking whether the time constraint relative to said next waypoint could be fulfilled; and B/ for each of the waypoints following said next waypoint, the following operations are carried out:

a) a minimum time of arrival and a maximum time of arrival are calculated being estimated at said waypoint to be considered, considering that the time constraint of the previous waypoint is fulfilled, said minimum and maximum times of arrival being calculated respectively based on the possible minimum and maximum speeds for the aircraft between the previous waypoint and said waypoint being considered;

b) said minimum time of arrival and said maximum time of arrival are compared to at least one comparison value (to be set forth below) depending on said required time of arrival at said waypoint to be considered;

c) this comparison is taken into consideration for checking whether the time constraint is fulfilled; and d) means are provided, including display means, for providing the results of said checks, for instance, to a pilot of the aircraft.

As the comparison of the required time of arrival RTA with the estimated time of arrival ETA is not adequate (because it is based on a large number of possible speeds for reaching the time RTA), the present invention provides, in the case of a plurality of constraints, a step of comparing, for each waypoint following the next waypoint, a comparison value (to be set forth below and depending on said required time of arrival) with minimum and maximum times of arrival based on fixed constant speeds of the aircraft. Thus, a simple calculation (and thus able to be carried out rapidly without iteration including by a flight management system) allows to determine whether time constraints located after the first time constraint will be fulfilled or not.

The present invention comprises:

a means for calculating the feasibility of n successive time constraints without having to calculate the n speed iterations; and a means for converting a window constraint into a simple one in the case of a window followed by a simple constraint so as to maximize the chances of meeting the simple constraint and without iteration.

The method according to this invention is a simple method for providing the pilot with an indication on fulfilling successive time constraints. The method does not provide recalculating the whole speed profile, so that the method requires reduced calculation abilities to be implemented.

Within the context of the present invention, a time constraint, that is the required time of arrival for a waypoint, could correspond:

either to a single time value, that is a usual time RTA, for instance 10H30;

or to a time window (10H10-10H40) defined between a minimum limit value (required minimum time of arrival: 10H10) and a maximum limit value (required maximum time of arrival: 10H40).

In a first embodiment, the required time of arrival is a single time value. In this case, advantageously, at step A/b), said estimated time of arrival is compared to said required time of arrival at the next waypoint (that is that the aircraft will reach first), representing said comparison value, and it is considered that the time constraint is fulfilled if these two times are equal by one margin.

Moreover, in this first embodiment, for which at least one required time of arrival at a waypoint other than the next waypoint is also a single time value:

at step B/b), said minimum time of arrival and said maximum time of arrival are compared to said required time of arrival representing said comparison value; and at step B/c), it is considered that the time constraint could be fulfilled if said required time of arrival is ranging between said minimum time of arrival and said maximum time of arrival.

Furthermore, in a second embodiment, at least one required time of arrival for a waypoint represents a time window being defined between minimum and maximum limit values. In such a case, advantageously, at step A/b), the estimated time of arrival is compared, on the one hand, to said minimum limit value, representing a first comparison value, and on the other hand, to said maximum limit value, representing a second comparison value, and it is considered that the time constraint is fulfilled (at the next waypoint) if said estimated time of arrival ranges between said minimum time of arrival and said maximum time of arrival.

Moreover, in this second embodiment, for which at least one required time of arrival at a waypoint other than the next waypoint also represents a time window (being defined between minimum and maximum limit values):

at step B/b), the minimum time of arrival and the maximum time of arrival are compared, on the one hand to said minimum limit value, representing a first comparison value, and on the other hand, to said maximum limit value, representing a second comparison value; and at step B/c), it is considered that the time constraint is able to be fulfilled if at least one of said minimum and maximum limit values ranges between said minimum time of arrival and said maximum time of arrival.

In this second embodiment, in addition to checking whether the time constraints could be fulfilled as described above, there is determined, advantageously, when the fulfillment is confirmed, an optimum time of arrival at the corresponding waypoint allowing both to fulfill this time constraint and to fulfill the next time constraint(s).

To this end, in a preferred embodiment, the following operations are carried out to calculate an optimum time of arrival, for a time window with an (n−1) index relative to an (n−1) index waypoint:

a first time of arrival Topt is calculated using the following relationship:

$$\mathrm{Top}t-\mathrm{RTA}n-(TTG\mathrm{min}+TTG\mathrm{max})/2,$$

wherein:

RTAn represents a required value for the n index next waypoint; and

TTGmin and TTGmax are minimum and maximum durations being necessary to the aircraft for flying from the (n−1) index waypoint to the next (n) index waypoint;

this first time of arrival Topt is compared to the minimum and maximum limit values of said (n−1) index time window; and it is considered that said optimum time of arrival corresponds:

to said first time of arrival Topt, if it ranges between said minimum and maximum limit values;

to said minimum limit value, if said first time of arrival is lower than or equal to the latter; and to said maximum limit value, if said first time of arrival is lower than or equal to the latter.

The present invention further relates to a device for checking whether an aircraft, during a flight of the aircraft, is able to fulfill a plurality of successive time constraints, each of which is relative to a required time of arrival in a particular waypoint.

According to this invention, said device is remarkable in that it comprises:

means for providing said required times of arrival;

means for determining the current speed of the aircraft;

means for estimating, as a function of said current speed of the aircraft, a time of arrival at said next waypoint;

means for comparing this estimated time of arrival to at least one comparison value depending on said required time of arrival at said next waypoint, for checking whether the time constraint relative to said next waypoint could be fulfilled;

means for calculating, for each one of the waypoints following said next waypoint, a minimum time of arrival and a maximum time of arrival being estimated at said waypoint being considered, considering that the time constraint of the previous waypoint is fulfilled, said minimum and maximum times of arrival being respectively calculated using possible minimum and maximum speeds for the aircraft between the previous waypoint and said waypoint being considered;

means for comparing said minimum time of arrival and said maximum time of arrival to at least one comparison value depending on said required time of arrival at said waypoint being considered, in order to check whether the time constraint is fulfilled; and means for transmitting the results of said checks.

The present invention also relates to:

an aircraft, in particular a civil or military transport airplane, being provided with a device such as mentioned hereinabove; and/or an aircraft system, for example an automatic guiding system, comprising such a device.

BRIEF DESCRIPTION OF DRAWINGS

The FIGS. of the appended drawings will better explain how this invention can be implemented. In these FIGS., like reference numerals relate to like components.

DETAILED DESCRIPTION

Figure 1:
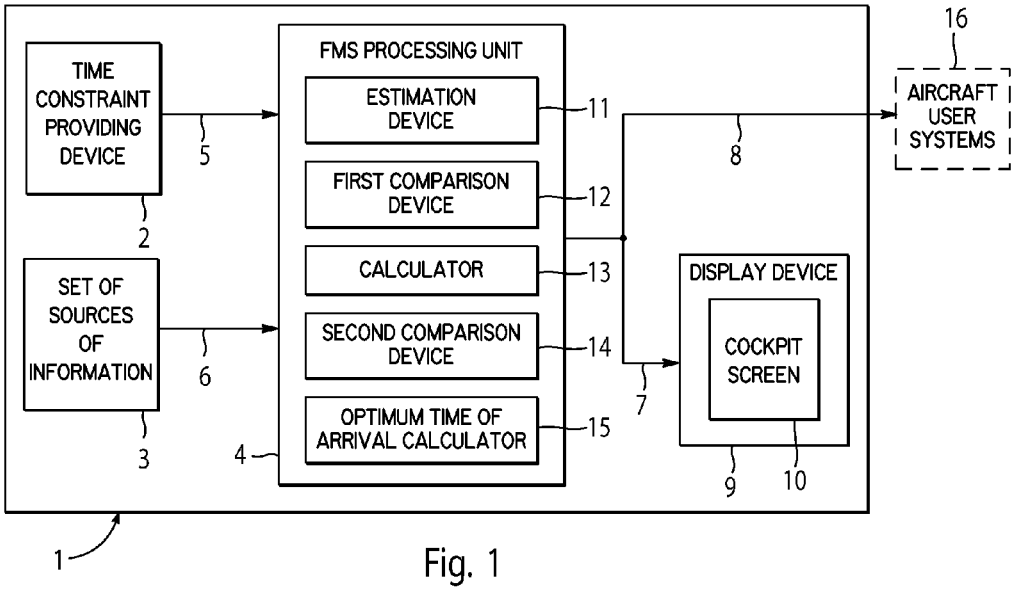
FIG. 1 is the block diagram of a device according to a first embodiment of this invention.

The time constraint checking device 1 according to this invention and schematically shown on FIG. 1 is intended for checking that, during a flight of an aircraft AC, for example a civil or military transport airplane, this aircraft AC is able to fulfill a plurality of successive time constraints. Each time constraint is relative to a required time of arrival in a particular "waypoint" of the flight trajectory followed by the aircraft. A time constraint could correspond to a given single time of arrival or to a given time window, as set forth below.

To this end, the device 1 being embedded on the aircraft A, comprises:

a time constraint providing device 2 able to provide successive time constraints to be fulfilled by the aircraft AC. Such time constraint providing device 2 could comprise a keyboard, allowing an operator, in particular a pilot of the aircraft A, to enter at least some of said time constraints. Such time constraint providing device 2 could also comprise a data base containing time constraints and providing them to the device 1;

a set 3 of sources of information being able to determine the values of parameters, such as the current speed of the aircraft A, being relative to the flight of said aircraft AC;

a processing unit 4 being part preferably of a flight management system of the FMS type, being connected via links 5 and 6 respectively to the time constraint providing device 2 and to the set 3, receiving information from the set 3, and carrying out processings, to be set forth below concerning the checks to be implemented; and links 7 and 8 for transmitting the results of the checks carried out by the processing unit 4.

Such results could, more specifically, be transmitted to a display device 9 (being part of the device 1) such as by displaying them on a screen 10 of the cockpit of the aircraft AC and/or to (not shown) sound or visual warning device, being able to warn the crew when constraints cannot be fulfilled.

According to this invention, said processing unit 4 comprises:

an estimation device 11 that estimates, as a function of the current speed of the aircraft (received from the set 3), a time of arrival at said next waypoint (that is the one the aircraft will reach first);

a first comparison device 12 that compares such estimated time of arrival to at least one comparison value (depending on said required time of arrival at said next waypoint), for checking whether the time constraint relative to said next waypoint could be fulfilled;

a calculator 13 that calculates, for each one of the waypoints following said next waypoint along the trajectory of the aircraft AC, a minimum time of arrival and a maximum time of arrival being estimated at said waypoint being considered, considering each time that the time constraint of the previous waypoint is fulfilled. Said minimum and maximum times of arrival are calculated by the calculator 13 respectively using possible minimum and maximum speeds for the aircraft AC between the previous waypoint and the waypoint being considered. Such minimum and maximum speeds are for example received from the set 3; and a second comparison device 14 that compares said minimum time of arrival and said maximum time of arrival to at least one comparison value (to be set forth hereinunder) depending on said required time of arrival at said waypoint being considered, in order to check whether the time constraint is fulfilled or not.

The device 1 according to the present invention thus provides, in the case of a plurality of successive time constraints, comparing, for each waypoint following the next waypoint, a comparison value (to be set forth below and depending on said required time of arrival) with minimum and maximum times of arrival based on fixed constant speeds of the aircraft AC. Thus, the checks could be carried out using simple calculations (to be set forth hereinunder) able to be implemented, rapidly and with reduced calculation ability requirements, by the processing unit 4.

The processing unit 4 is adapted to perform the following functions:

calculating the feasibility of n successive time constraints without having to calculate the n speed iterations; and converting a window constraint into a simple one in the case of a window constraint followed by a simple constraint so as to maximize the chances of meeting the simple constraint and without iteration-type processing.

Within the context of the present invention, a time constraint, that is the required time of arrival for the next waypoint, could correspond:

either to a single time value, that is a usual time RTA, for instance 10H30;

or to a time window (10H10-10H40) being defined between a minimum limit value (required minimum time of arrival: 10H10) and a maximum limit value (required maximum time of arrival: 10H40).

In a first embodiment, the required time of arrival is a single time value.

In such a case, the first comparison device 12 compare the estimated time of arrival with said required time of arrival at the next waypoint (that is the one the aircraft AC will reach first), representing said comparison value, and the time constraint is fulfilled if these two times are equal by one predetermined margin, for example of a few minutes.

In addition, in this first embodiment, for which at least one required time of arrival at a waypoint other than the next waypoint is also one single time value, the calculator 13 compare said minimum time of arrival and said maximum time of arrival with said required time of arrival at said waypoint being considered, representing said comparison value. Moreover, the time constraint is fulfilled if said required time of arrival ranges between said minimum time of arrival and said maximum time of arrival.

Consequently, two cases are to be distinguished:

the next time constraint on the trajectory of the aircraft AC; and every next time constraint.

The first (or next) time constraint the aircraft AC will meet (at point P1 of FIG. 2) is processed as in the case of a single constraint. An adapted speed profile is calculated by the processing unit 4 so as to fulfill it, amongst the possible profile solutions. This calculation is based on the comparison of the constraint RTA with the estimated time of arrival ETA at said point P1.

For each next constraint RTA, the processing unit 4 supposes that the previous time constraint is fulfilled, and calculates the minimum time of arrival ETAmin and the maximum time of arrival ETAmax at the waypoint being considered. Thus, if the constraint RTA is within the interval given par ETAmin and ETAmax (illustrated by arrows F1 and F2 on FIG. 2), it is fulfilled, otherwise it is not.

Figure 2:
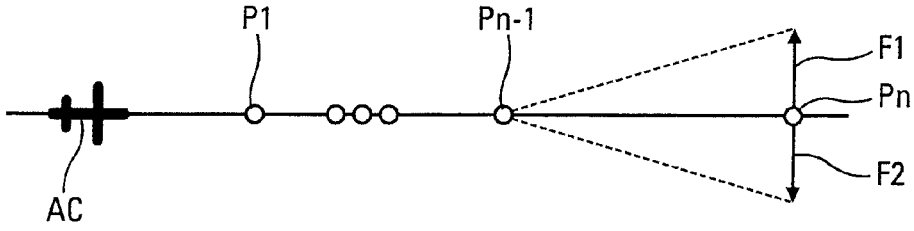
FIG. 2 is a diagram illustrating additional characteristics of the first embodiment of this invention.

As shown on FIG. 2, if the constraint RTAn (at point Pn) is within the interval (ETAmin, ETAmax), then, it will be fulfilled. If not, the pilot already knows, before the constraint RTAn−1 (point Pn−1) that the constraint RTAn will not be fulfilled and can act accordingly. This applies similarly for the next constraints, still supposing that the previous constraint is fulfilled and calculating the minimum time of arrival ETAmin and the maximum time of arrival ETAmax, on the segment between the two constraints.

Furthermore, in a second embodiment, at least one required time of arrival for a waypoint represents a time window being defined between minimum and maximum limit values. In this case, it is possible not to fulfill the next time constraints while fulfilling the first constraint, from the choice of the adopted speed profile, as illustrated on FIG. 3.

Figure 3:
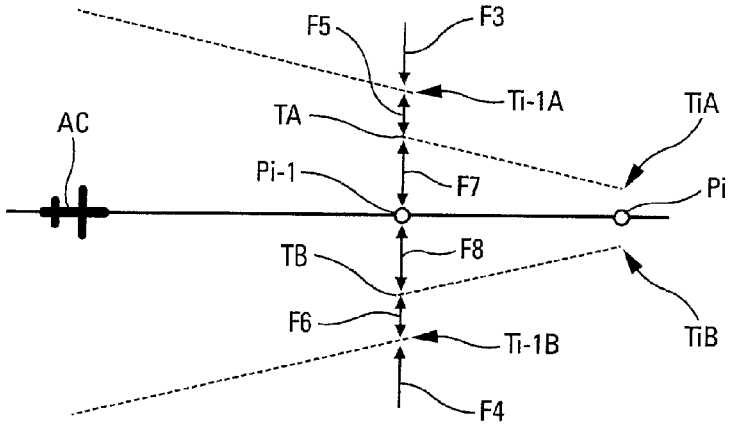
FIG. 3 is a diagram enabling to explain the problems encountered with one or more of the time constraints representing a time window when using the device shown in FIG. 1.

On this FIG. 3, there are shown:

one waypoint Pi−1, with which a required time of arrival is associated representing a time window being defined between a minimum limit value Ti−1A and a maximum limit value Ti−1B; and one waypoint Pi, with which a required time of arrival is associated representing a time window being defined between a minimum limit value Ti A and a maximum limit value TiB.

In this situation:

if the aircraft AC reaches the waypoint Pi−1 outside the time window defined between Ti−1A and Ti−1B, as illustrated by arrows F3 and F4, the constraint RTAi−1 (at said point Pi−1) is not fulfilled;

if the aircraft AC reaches the waypoint Pi−1 between Ti−1A and TA or between Ti−1B and TB, as illustrated by double arrows F5 and F6, the constraint RTAi−1 (at said point Pi−1) is fulfilled, but the constraint RTAi1 at point Pi1 cannot be fulfilled;

in order for the constraints RTAi−1 (at point Pi−1) and RTAi1 (at point Pi1) to be able to be both fulfilled, the aircraft AC should reach the waypoint Pi−1 between TA and TB, as illustrated by double arrows F7 and F8.

In this second embodiment, the first comparison device 12 compares the estimated time of arrival at the next waypoint, on the one hand, to the minimum limit value (of the time window), representing a first comparison value, and on the other hand, to the maximum limit value (of the time window), representing a second comparison value, and they consider that the time constraint is fulfilled if said estimated time of arrival ranges between said minimum time of arrival and said maximum time of arrival.

Moreover, in this second embodiment, it is considered that at least one required time of arrival at a waypoint other than the next waypoint also represents a time window (being defined between minimum and maximum limit values. In this case, the second comparison device 14 compares said minimum time of arrival and said maximum time of arrival, on the one hand to said minimum limit value, representing a first comparison value, and on the other hand, to said maximum limit value, representing a second comparison value. In addition, they consider that the time constraint is able to be fulfilled if at least one of said minimum and maximum limit values ranges between said minimum time of arrival and said maximum time of arrival.

Figure 4:
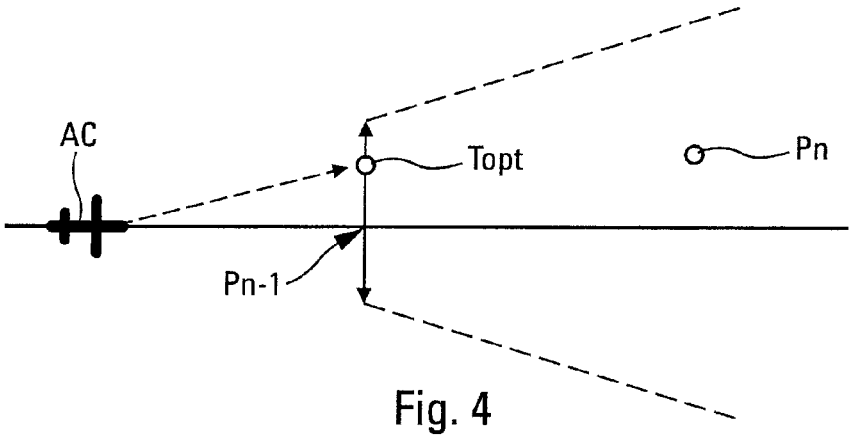
FIG. 4 is a diagram allowing the characteristics of this invention to be improved, with reference to a second embodiment of the invention.

In this second embodiment, in addition to checking whether the time constraints could be fulfilled as described above, the processing unit 4 also determines, when the fulfillment is confirmed, an optimum time of arrival Topt at the corresponding waypoint (for example at Pn−1 as shown on FIG. 4). This optimum time of arrival allows both to fulfill this time constraint (a Pn−1) and to fulfill the next time constraints (and including at the next point Pn, also shown on FIG. 4).

To this end, in a preferred embodiment, the optimum time of arrival calculator 15 of the processing unit 4 carries out the following operations, for a (n−1) index time window relative to a (n−1) index waypoint Pn−1:

calculating a first time of arrival Topt, using the following relationship:

$$\mathrm{Top}t=\mathrm{RTA}n-(TTG\mathrm{min}+TTG\mathrm{max})/2,$$

wherein:

RTAn represents a required value for the (n) index next waypoint. RTAn is a simple constraint; and TTGmin and TTGmax are minimum and maximum durations being necessary to the aircraft for flying from the (n−1) index waypoint to the next (n) index waypoint;

comparing this first time of arrival Topt to the minimum and maximum limit values of said (n−1) index time window; and determining that said optimum time of arrival corresponds to said first time of arrival Topt, if it ranges between said minimum and maximum limit values.

On the other hand, if said first time of arrival is outside said minimum and maximum limit values, the optimum time of arrival calculator 15 limit it so that it remains within the time window. More precisely, the optimum time of arrival calculator 15 considers that the optimum time of arrival corresponds:

to said minimum limit value, if said first time of arrival is lower than or equal to the latter; and to said maximum limit value, if said first time of arrival is higher than or equal to the latter.

The strategy to be adopted thus involves calculating the optimum hour of arrival at the constraint RTA1 allowing this constraint to be fulfilled as well as the next constraint(s). This amounts to convert the constraint as a window into an optimized simple constraint such that the simple constraint is contained within the window.

As can be seen on FIG. 4, the optimum time of arrival Topt should be calculated for optimizing the fulfillment of the two constraints. It is both tried to leave as much margin before and after RTAn while fulfilling the constraint (n−1).

The calculation could be described using the following formula:

$$RTA_n = \tfrac{1}{2}(ETAmin(WPT_n, Top_t) + ETAmax(WPT_n, Top_t)),$$

where Topt is thus the optimized time of arrival at RTAn−1. ETAmin(WPTn, Topt) is the minimum hour (or time) of arrival at point WPTn, going through point WPTn−1 at time Topt.

Now, as ETAmin/max(WPTn; Topt)=Topt+TTGmin/max Time to Go ("TTG") is the duration necessary for the aircraft to fly from RTAn−1 to RTAn. This duration is constant, as it is defined by the window RTAn−1 and by RTAn. The following is obtained:

$$RTA_n = \tfrac{1}{2}(Top_t + TTG_{min} + Top_t + TTG_{max}) \text{ hence, } Top_t = RTA_n - \tfrac{1}{2}(TTG_{min} + TTG_{max}).$$

The variations of Topt should also be limited to the window RTA so as to ensure that the first constraint is actually fulfilled.

Figure 5:
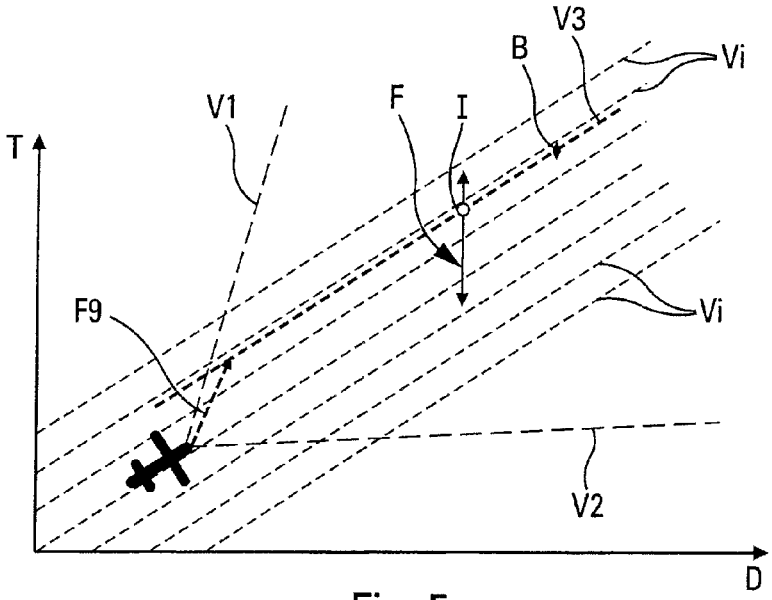
FIG. 5 is a diagram allowing the characteristics of this invention to be improved, with reference to a second embodiment of the invention.

The time/distance diagram on FIG. 5 (time T, distance D) allows to more easily explain the situation. On this diagram:

the straight lines Vi represent iso-speeds starting from a given time and from a given waypoint. If these straight lines are followed, the places where to arrive as well as the time at which to arrive are obtained if the corresponding speed is kept;

O represents the optimum point;

F represents the window RTA;

B represents a RTA simple time;

V1 and V2 are minimum and maximum speeds; and

V3 is an optimum mean speed.

Furthermore, in order to optimize at most the chances to fulfill the constraints RTA, it is tried to switch to the constraint RTA with a mean speed Vmean=½(Vmax+Vmin). Thus, in the case of wind or of another problem, a margin is obtained on the speed however allowing the constraint to be fulfilled.

The window constraint will also be converted into a simple constraint, and the optimum point I is determined, where to reach the window so as to be at the mean speed. For optimizing the chances to fulfill the two constraints, the mean speed line V3 should thus be reached (slowing down or accelerating) as soon as possible (as illustrated by the arrow F9 on FIG. 5), then this mean speed value V3 should be maintained.

In a particular embodiment, said device 1 could also provide the results of its checks and of its calculations to user systems 16 of the aircraft (via the link 8), and in particular to a usual automatic guiding system calculating, for example, speed instructions allowing to respect more specifically the optimum time of arrival (calculated by the processing unit) and applying such speed instructions to the aircraft AC.

The invention claimed is:

1. A method for checking whether, an aircraft having a flight management system (FMS) with an FMS processing unit, during a flight of the aircraft along a plurality of waypoints, is able to fulfill a plurality of successive time constraints, each of which is corresponding to a required time of arrival at a particular waypoint, the method comprising:

receiving, with the FMS processing unit, the plurality of successive time constraints from a time constraint providing device connected to the FMS processing unit;

receiving, with the FMS processing unit, a current speed of the aircraft from a set of sources of information connected to the FMS processing unit;

(A) for a next waypoint that the aircraft will reach along the plurality of waypoints, performing the following operations with the FMS processing unit:

(a) estimating, as a function of the current speed of the aircraft, a time of arrival at the next waypoint; and (b) comparing the time of arrival at the next waypoint to at least one comparison value depending on a time constraint relative to the next waypoint chosen from the plurality of successive time constraints, to thereby check whether the time constraint relative to said next waypoint can be fulfilled by the aircraft; and (B) for each other waypoint that the aircraft will reach following the next waypoint, performing the following operations with the FMS processing unit:

(a) calculating a minimum time of arrival and a maximum time of arrival for the waypoint considered, provided that a time constraint of a previous waypoint in the plurality of successive time constraints is fulfilled, the minimum time of arrival and the maximum time of arrival being calculated, respectively, based on minimum and maximum speeds possible for the aircraft between the previous waypoint and the waypoint considered;

(b) comparing the minimum time of arrival and the maximum time of arrival to at least one comparison value depending on a time constraint relative to the waypoint considered; and (c) checking whether the time constraint relative to the waypoint considered can be fulfilled by the aircraft, based on the comparing in step (B)/(b); and transmitting, with links connected to the FMS processing unit, results of the checks carried out by the FMS processing unit in steps (A)/(b) and (B)/(c), to at least one of a display device and aircraft user systems, wherein at least one of the plurality of successive time constraints for the plurality of waypoints includes a time window being defined between minimum and maximum limit values, and wherein, for each waypoint having a time window for the time constraint:

at step (B)/(b), the minimum time of arrival and the maximum time of arrival are compared by the FMS processing unit to the minimum limit value of the time window, representing a first comparison value, and also to the maximum limit value of the time window, representing a second comparison value; and at step (B)/(c), the FMS processing unit determines that the time constraint can be fulfilled by the aircraft if at least one of the minimum and maximum limit values of the time window ranges between the minimum time of arrival and the maximum time of arrival in step (B)/(b).

2. The method according to claim 1, wherein the time constraint for the next waypoint that the aircraft will reach is a single time value, and the comparing in step (A)/(b) further comprises:

comparing the time of arrival estimated in step (A)/(a) to the single time value, representing the comparison value, and determining that the time constraint is fulfilled if the time of arrival and the single time value are equal within a predetermined time margin.

3. The method according to claim 1, wherein the time constraint for at least one of the other waypoints that the aircraft will reach following the next waypoint is a single time value, and wherein:

step (B)/(b) further comprises:

comparing the minimum time of arrival and the maximum time of arrival to the single time value representing the comparison value; and step (B)/(c) further comprises:

determining that the time constraint is fulfilled if the single time value ranges between the minimum time of arrival and the maximum time of arrival.

4. The method according to claim 1, wherein the time constraint for the next waypoint that the aircraft will reach is a time window being defined between minimum and maximum limit values, and the comparing in step (A)/(b) further comprises:

comparing the time of arrival estimated in step (A)/(a) to the minimum limit value, representing a first comparison value, and also to the maximum limit value, representing a second comparison value, and determining that the time constraint is fulfilled if the time of arrival ranges between the minimum limit value and the maximum limit value.

5. The method according to claim 1, wherein, for any of the successive time constraints for the plurality of waypoints that is a time window, step (A) or step (B) further comprises performing the following operation with the FMS processing unit:

determining an optimum time of arrival at each selected waypoint associated with a time constraint that is a time window, the optimum time of arrival enabling the time constraint for the associated waypoint to be fulfilled and enabling time constraints for waypoints reached by the aircraft after the associated waypoint to be fulfilled.

6. The method according to claim 5, wherein, for an (n−1) index time window having minimum and maximum limit values relative to an (n−1) index waypoint determining the optimum time of arrival further comprises:

calculating a first time of arrival Topt, using the relationship:

$$\mathrm{Top}t=\mathrm{RTA}n-(TTG\mathrm{min}+TTG\mathrm{max})/2,$$

wherein RTAn represents a required value for the (n) index waypoint; and TTGmin and TTGmax are minimum and maximum time durations necessary for the aircraft to fly from the (n−1) index waypoint to the (n) index waypoint;

comparing the first time of arrival Topt to the minimum and maximum limit values of the (n−1) index time window; and determining that the optimum time of arrival is:

equal to the first time of arrival Topt, if the first time of arrival ranges between the minimum and maximum limit values;

equal to the minimum limit value, if the first time of arrival is lower than or equal to the minimum limit value; and equal to the maximum limit value, if the first time of arrival is higher than or equal to the maximum limit value.

7. A time constraint checking device for checking whether, an aircraft having a flight management system (FMS), during a flight of the aircraft along a plurality of waypoints, is able to fulfill a plurality of successive time constraints, each of which is corresponding to a required time of arrival at a particular waypoint, the device comprising:

a FMS processing unit incorporated with the flight management system;

a time constraint providing device connected to the FMS processing unit that provides the plurality of successive time constraints to the FMS processing unit;

a set of sources of information that determine a current speed of the aircraft and provide the current speed to the FMS processing unit;

the FMS processing unit further comprising one or more processing components that perform the following steps:

(A) for a next waypoint that the aircraft will reach along the plurality of waypoints, performing the following operations with the FMS processing unit:

(a) estimating, as a function of the current speed of the aircraft, a time of arrival at the next waypoint; and (b) comparing the time of arrival at the next waypoint to at least one comparison value depending on a time constraint relative to the next waypoint chosen from the plurality of successive time constraints, to thereby check whether the time constraint relative to said next waypoint can be fulfilled by the aircraft; and (B) for each other waypoint that the aircraft will reach following the next waypoint, performing the following operations with the FMS processing unit:

(a) calculating a minimum time of arrival and a maximum time of arrival for the waypoint considered, provided that a time constraint of a previous waypoint in the plurality of successive time constraints is fulfilled, the minimum time of arrival and the maximum time of arrival being calculated, respectively, based on minimum and maximum speeds possible for the aircraft between the previous waypoint and the waypoint considered;

(b) comparing the minimum time of arrival and the maximum time of arrival to at least one comparison value depending on a time constraint relative to the waypoint considered; and (c) checking whether the time constraint relative to the waypoint considered can be fulfilled by the aircraft, based on the comparing in step (B)/(b); and links connected to the FMS processing unit that transmit the results of checks carried out by the FMS processing unit in steps (A)/(b) and (B)/(c), to at least one of a display device and aircraft user systems, wherein at least one of the plurality of successive time constraints for the plurality of waypoints includes a time window being defined between minimum and maximum limit values, and wherein, for each waypoint having a time window for the time constraint:

at step (B)/(b), the FMS processing unit compares the minimum time of arrival and the maximum time of arrival to the minimum limit value of the time window, representing a first comparison value, and also to the maximum limit value of the time window, representing a second comparison value; and at step (B)/(c), the FMS processing unit determines that the time constraint can be fulfilled by the aircraft if at least one of the minimum and maximum limit values of the time window ranges between the minimum time of arrival and the maximum time of arrival in step (B)/(b).

8. An aircraft, comprising:

a flight management system; and the time constraint checking device of claim 7.

9. The time constraint checking device of claim 7, wherein the FMS processing unit further comprises a component that calculates an optimum time of arrival at each selected waypoint associated with a time constraint that is a time window defined between minimum and maximum limit values, the optimum time of arrival enabling the time constraint for the associated waypoint to be fulfilled and enabling time constraints for waypoints reached by the aircraft after the associated waypoint to be fulfilled, and the calculation of the optimum time of arrival further comprises:

calculating a first time of arrival Topt, using the relationship:

$$\mathrm{Top}t=\mathrm{RTA}n-(TTG\min+TTG\max)/2,$$

wherein RTAn represents a required value for the (n) index waypoint; and TTGmin and TTGmax are minimum and maximum time durations necessary for the aircraft to fly from the (n−1) index waypoint to the (n) index waypoint;

comparing the first time of arrival Topt to the minimum and maximum limit values of the (n−1) index time window; and determining that the optimum time of arrival is:

equal to the first time of arrival Topt, if the first time of arrival ranges between the minimum and maximum limit values;

equal to the minimum limit value, if the first time of arrival is lower than or equal to the minimum limit value; and equal to the maximum limit value, if the first time of arrival is higher than or equal to the maximum limit value.

* * * * *